US007036713B2

(12) United States Patent
Lee

(10) Patent No.: US 7,036,713 B2
(45) Date of Patent: May 2, 2006

(54) TETRAHEDRON/PENTAHEDRON CONTAINER

(76) Inventor: Jung Min Lee, 1208 Misung Apt. A-dong, 37 Yeoueudo-dong, Youngdungpo-gu, Seoul (KR) 150-010

( * ) Notice: Subject to any disclaimer, the term of this patent is extended or adjusted under 35 U.S.C. 154(b) by 171 days.

(21) Appl. No.: 10/485,586

(22) PCT Filed: Aug. 3, 2002

(86) PCT No.: PCT/KR02/01473

§ 371 (c)(1),
(2), (4) Date: Feb. 2, 2004

(87) PCT Pub. No.: WO03/013963

PCT Pub. Date: Feb. 20, 2003

(65) Prior Publication Data

US 2005/0061864 A1 Mar. 24, 2005

(30) Foreign Application Priority Data

Aug. 3, 2001 (KR) ..... 2001-48119
Aug. 3, 2001 (KR) ..... 2001-48120

(51) Int. Cl.
*B65D 5/74* (2006.01)

(52) U.S. Cl. ..... 229/116; 229/115; 229/125.42; 229/214; 383/906; 383/907

(58) Field of Classification Search ..... 229/115, 229/116, 125.42, 213, 214, 216; 206/436; 383/66, 104, 120, 203, 906, 907
See application file for complete search history.

(56) References Cited

U.S. PATENT DOCUMENTS

| | | | | | |
|---|---|---|---|---|---|
| 446,518 | A | * | 2/1891 | Hesser | 383/907 |
| 2,138,700 | A | * | 11/1938 | Hoff | 229/214 |
| 2,321,139 | A | * | 6/1943 | Gruger | 229/214 |
| 3,038,649 | A | * | 6/1962 | Rausing | 229/116 |
| 3,077,295 | A | * | 2/1963 | Whiteford | 383/104 |
| 3,083,876 | A | * | 4/1963 | Schneider et al. | 229/116 |
| 3,367,551 | A | * | 2/1968 | Wheeler | 383/66 |
| 3,653,576 | A | * | 4/1972 | Stranicky | 229/115 |
| 4,228,898 | A | * | 10/1980 | Zeitter et al. | 229/214 |
| 4,339,067 | A | | 7/1982 | Bessey | 299/22 |
| 4,571,337 | A | * | 2/1986 | Cage et al. | 383/104 |
| 4,813,546 | A | * | 3/1989 | Gordon et al. | 229/214 |
| 5,083,700 | A | * | 1/1992 | Mello et al. | 229/115 |
| 5,322,211 | A | * | 6/1994 | Petersen | 229/125.42 |
| 5,326,024 | A | * | 7/1994 | Fogle | 229/214 |
| 5,437,406 | A | * | 8/1995 | Gordon et al. | 229/115 |
| 6,047,817 | A | * | 4/2000 | Taylor et al. | 383/120 |
| 6,164,826 | A | * | 12/2000 | Petkovsek | 383/120 |
| 6,857,779 | B1 | * | 2/2005 | Olin | 383/104 |

FOREIGN PATENT DOCUMENTS

| | | |
|---|---|---|
| EP | 0 577 989 A1 | 12/1994 |
| JP | 50-101591 U | 1/1974 |
| JP | 55-166720 U | 12/1980 |

* cited by examiner

*Primary Examiner*—Gary E. Elkins
(74) *Attorney, Agent, or Firm*—Norris McLaughlin & Marcus PA; Christa Hildebrand

(57) ABSTRACT

A container includes at least one triangular surface, a sealing portion formed extending straightly from an angular point of the triangular surface, and an opening structure formed by folding a portion around the angular point of the container.

7 Claims, 4 Drawing Sheets

【FIG 1】
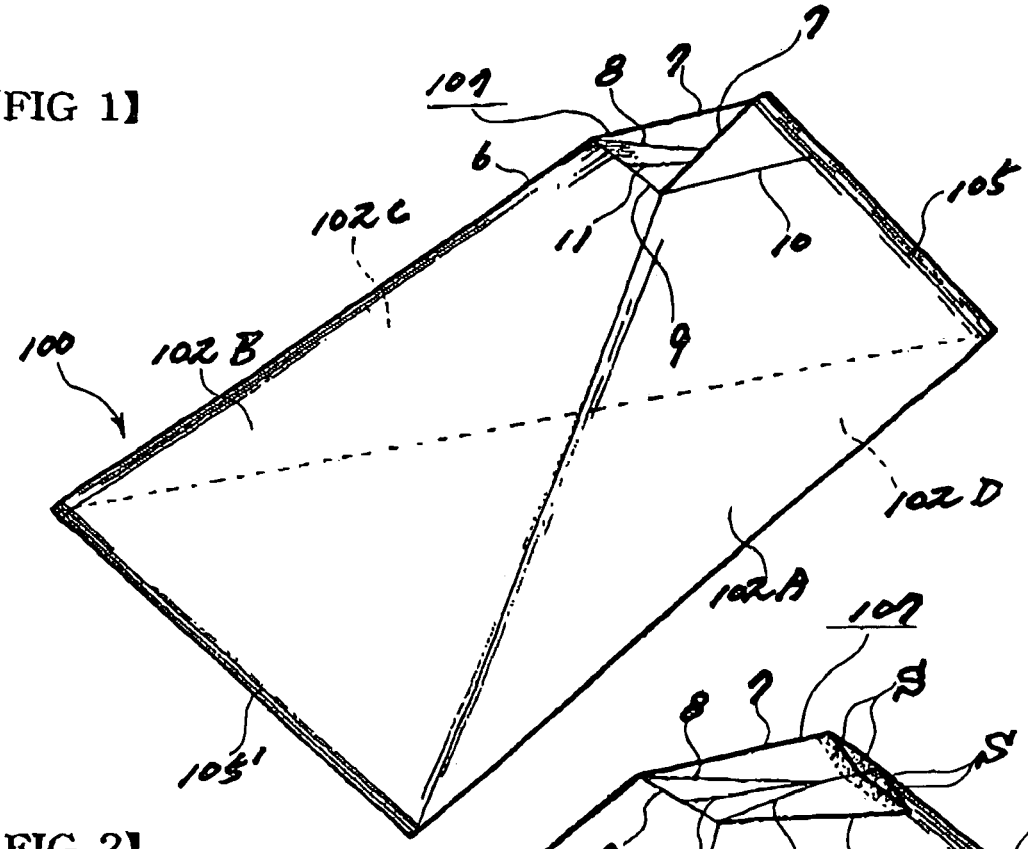
【FIG 2】
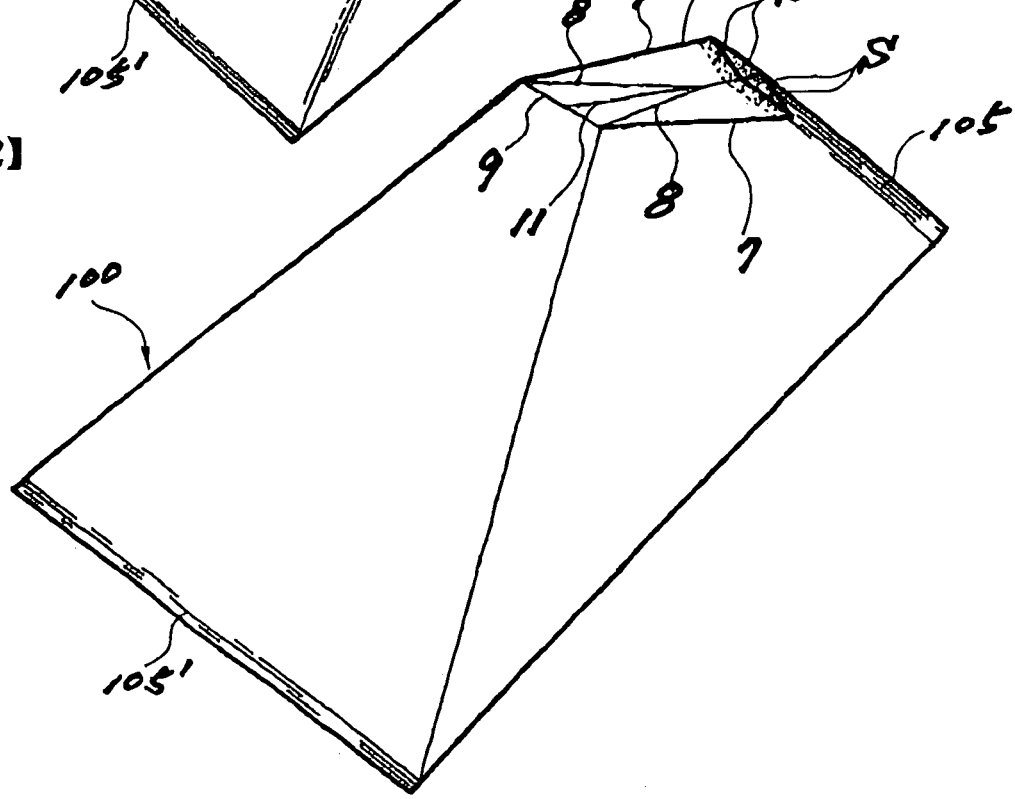

【FIG 3】
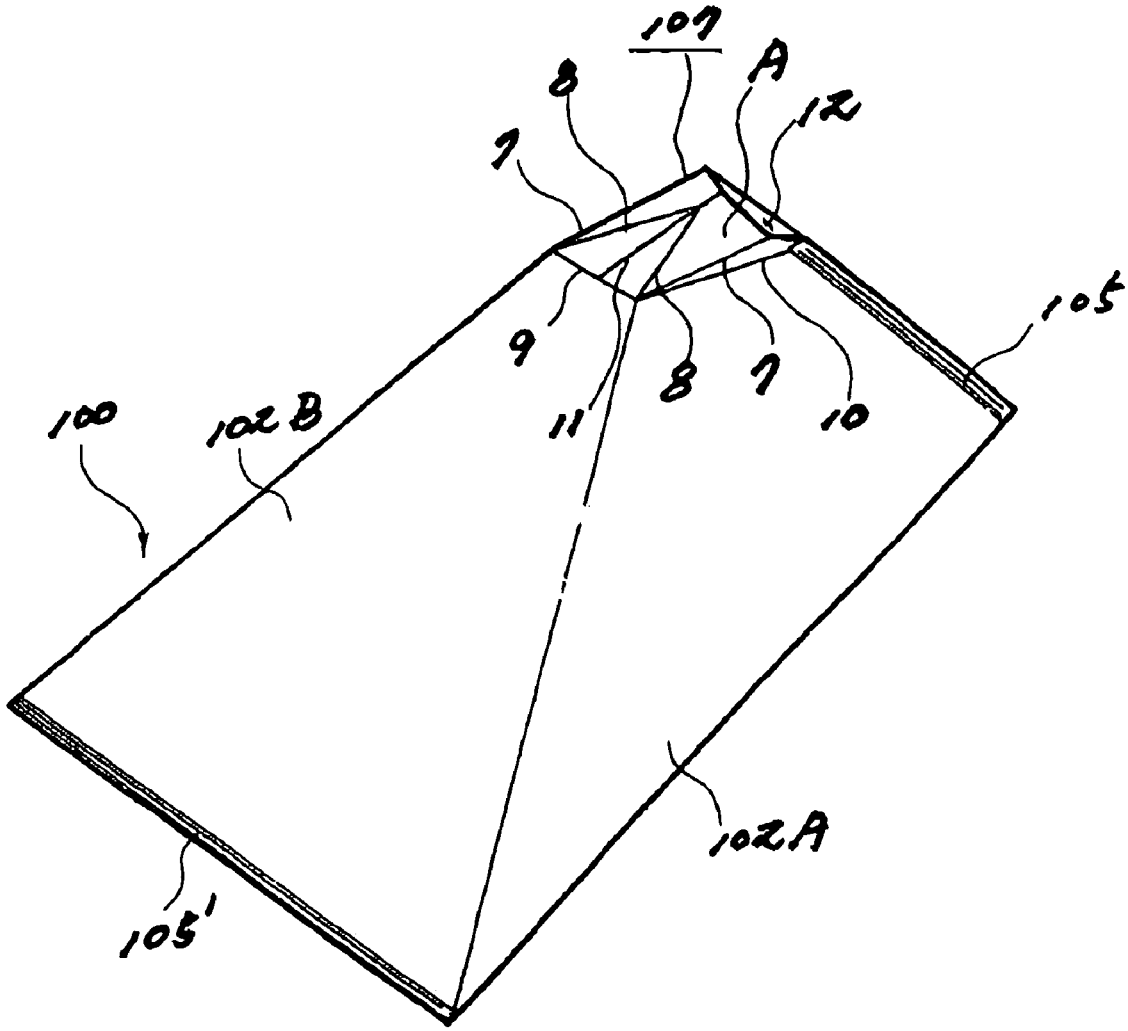

【FIG 4】
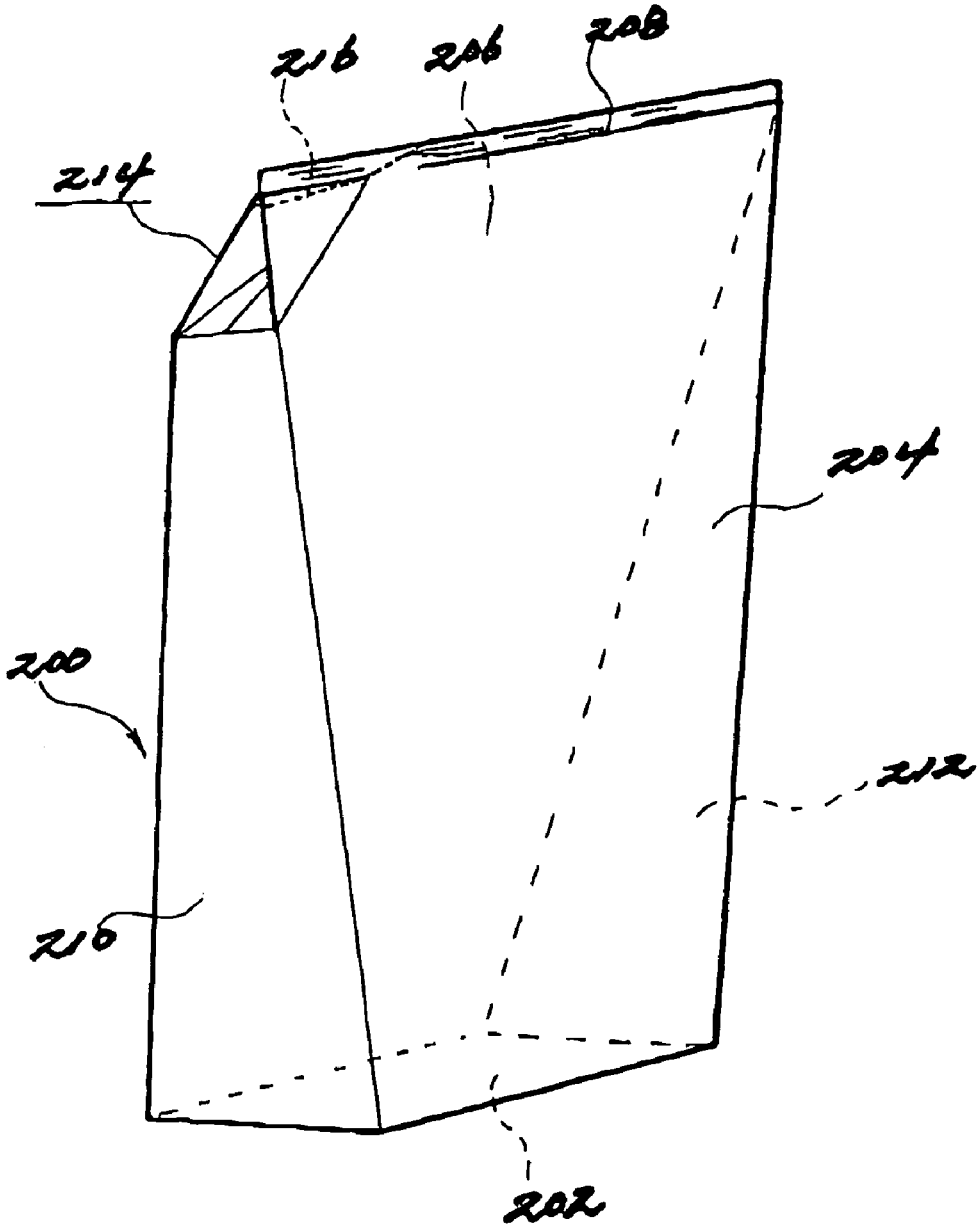

【FIG 5】
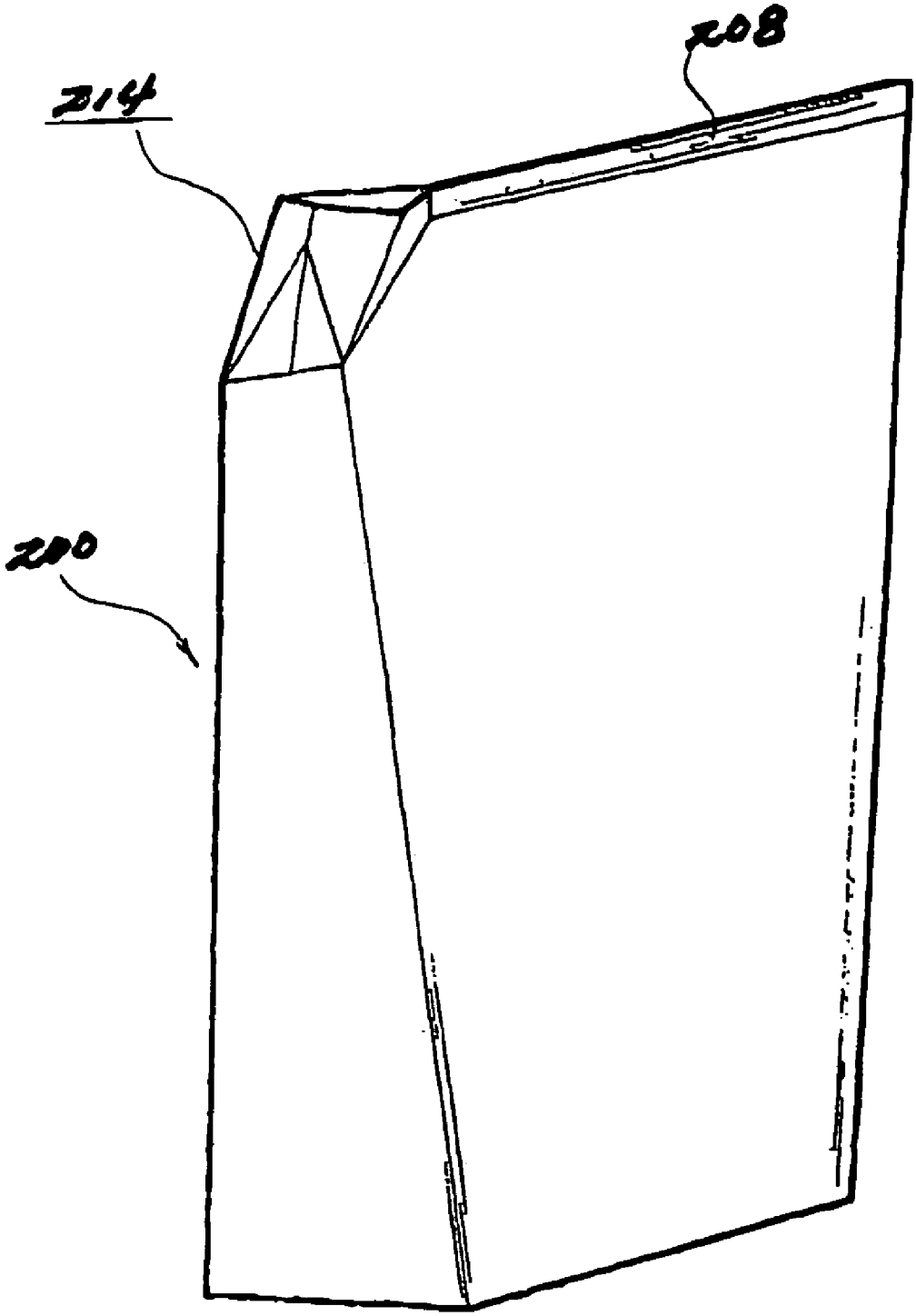

TETRAHEDRON/PENTAHEDRON CONTAINER

TECHNICAL FIELD

The present invention relates to a tetrahedron/pentahedron container having at least one inline sealing portion and, more particularly, to a tetrahedron/pentahedron container having an opening structure that can be easily opened.

BACKGROUND ART

Generally, to open a conventional container, a portion of top portion thereof should be cut-away using an additional tool such as scissors. Therefore, it is a troublesome for a user to have to use such a tool whenever the user intends to open the container To solve the above problems, containers each having an easy opening structure have been provided for a square/hexahedron container. However, such an easy opening structure cannot be applied to a tetrahedron or pentahedron container due to its structural limitation.

DISCLOSURE OF INVENTION

Therefore, the present invention has been made in an effort to solve the above-described problems of the prior art. It is an objective of the present invention to provide a tetrahedron or pentahedron container with an easy opening structure.

To achieve the above objective, the present invention provides a container comprising at least one triangular surface; a sealing portion formed extending straightly from an angular point of the triangular surface; and an opening structure formed by folding a portion around the angular point of the container.

Preferably, the opening structure is formed by first folding lines and second folding lines that are formed in the vicinity of both sides of the triangular surfaces proximal to the angular point to define a triangular folded surfaces innerwardly of the container.

Preferably, a third folding line may be formed on the folded triangular surfaces between the first folding lines so as to enhance an opening/close operation of the opening structure.

Further preferably, fourth folding lines may be formed outwardly in the vicinity of the second folding lines.

Further preferably, a fifth folding line is provided to horizontally connect one ends of the first to fourth folding lines to each other.

An overlapped portion defined by folding the opening structure and corresponding to the sealing portion is sealed by adhesive.

A cutting line may be provided to the overlapped portion so that the opening structure can be easily opened.

The container is formed of a triangular/tetrahedron body or a pentahedron body.

BRIEF DESCRIPTION OF THE DRAWINGS

FIG. 1 is a perspective view of a tetrahedron container according to a first embodiment of the present invention;

FIG. 2 is a view illustrating an opening process of a tetrahedron container of the present invention;

FIG. 3 is a view illustrating an opened state of a tetrahedron container of the present invention;

FIG. 4 is a perspective view of a pentahedron container according to a second embodiment of the present invention; and FIG. 5 is a view illustrating an opened state of a pentahedron container of the present invention.

BEST MODE FOR CARRYING OUT THE INVENTION

Preferred embodiments of the present invention will be described more in detail hereinafter in conjunction with the accompanying drawings.

In addition, material used for a container of the present invention is formed of material selected from the group consisting of paper, synthetic resin, and aluminum foil.

FIG. 1 shows a triangular-tetrahedron container according to a first embodiment of the present invention.

As shown in the drawings, the inventive container is formed in a tetrahedron comprising four triangular surfaces 102A, 102B, and 102C.

The container has inline top and bottom sealing portions 105 and 105' that are disposed parallel to each other. One of the inline top and bottom sealing portions 105 is provided with an inventive opening structure of the present invention. That is, the opening structure 107 is provided on a portion where the one of the sealing portions 105 and 105' meets an angular point of two sides of one of the triangular surfaces 102A, 102B and 102C.

Describing more in detail, a portion around the angular point is folded innerwardly in a triangular shape by first and second folding lines 7 and 8.

In addition, the opening structure 107 is further provided with a horizontal folding line 9 horizontally connecting the two sides of the triangular surface 102B. The folding lines 7 and 8 are formed from both ends of the folding line 9 and converged at a point to define the triangularly shaped portion. The opening structure 107 may be further provided with a central folding line 11 that connects a mid-point of the folding line 9 to the converged point of the folding lines 8. Outer folding lines 10 may be further provided outwardly of the folding lines 7.

The opening structure 107 may be applied at its portion corresponding to the sealing portion 105 with an adhesive portion S (see FIG. 2).

The opening method of the above-described opening structure will be described hereinafter.

From a state of FIG. 1, when the adhesive portion S (which is to be an opened) is unfolded on the basis of the folding lines 7, the adhesive portion is separated. In this state, when the folding lines 7 are pushed toward each other, a pouring opening 12 is formed by the folding lines 8 and 9 as shown in FIG. 2.

From this state, to reclose the opening structure, an unfolded front portion A defined by the folding lines 7 is pushed inwardly such that it can be folded on the basis of the folding lines 8, thereby reclosing the pouring portion 12 as shown in FIG. 1.

FIG. 4 shows a pentahedron container according to a second embodiment of the present invention. The opening structure of this embodiment is similar to that of the first embodiment.

The container of this embodiment has an inline sealing top 208, a rectangular sealing bottom 202, reverse trapezoidal front and rear surfaces 204 and 206, and both triangular side surfaces 210 and 212 connecting the front and rear surfaces 204 and 206.

An opening structure 214 of this embodiment is provided in the vicinity of around an angular point of one of the triangular side surfaces 210 and 212 over the sealing top 208 and the front and rear surfaces 204 and 206.

In this embodiment, a cutting line 216 is provided to the opening structure 214. That is, when the opening structure is too strongly attached, the opening structure may not be easily opened. In this case, the cutting line can be cut-away to easily open the opening structure.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

INDUSTRIAL APPLICABILITY

As is well known from the above-described embodiments, the container of the present invention can be used for storing beverages such as milk and juice so that the user can suck or dispense the beverages. The container can be also used for storing industrial fluid such as detergent and oil as it is designed to easily pour the contents without spilling them.

The invention claimed is:

1. A container comprising:

a plurality of adjacent surfaces connected by folds or sealed seams, at least one of the pluralities of surfaces is formed as a triangular surface having a top portion defined as an angular area;

a sealing portion formed by at least two of the plurality of surfaces adjacent to the triangular surface and the angular area, extending straightly from the angular area; and an opening structure formed by folding a portion of the angular area of the at least one triangular surface into the container, wherein the opening structure is defined by folding lines, including a horizontal folding line extending across the triangual surface between two adjacent surfaces and a pair of first folding lines (8) formed between the triangular surface and the respective adjacent surfaces, and the pair of second folding lines (7) extending along the two respective adjacent surfaces, the pair of first and the pair of second folding lines converge towards the sealing portion when closed.

2. The container of claim 1, wherein a third folding line is formed on the opening structure, extending perpendicular from the horizontal folding line to the sealing portion so as to enhance an opening/close operation of the opening structure.

3. The container of claim 2, wherein a pair of fourth folding lines extend from the horizontal folding line to the sealing portion away from pair of second folding lines.

4. The container of claim 1, wherein an-overlapped the sealing portion is sealed by adhesive.

5. The container of claim 4, wherein a cutting line is provided at the sealing portion, so that the opening structure can be easily opened.

6. The container of claim 1, wherein the plurality of adjacent surfaces are connected by folds or sealed seams to form a triangular-tetrahedron body.

7. The container of claim 1, wherein the plurality of adjacent surfaces are connected by folds or sealed seams to form of a pentahedron body.

* * * * *